United States Patent [19]

Ahs et al.

[11] Patent Number: 4,895,619

[45] Date of Patent: Jan. 23, 1990

[54] METHOD OF DELIGNIFICATION OF CELLULOSIC FIBER MATERIAL

[75] Inventors: Björn Ahs; Rune Hillström, both of Karlstad, Sweden

[73] Assignee: Kamyr AB, Karlstad, Sweden

[21] Appl. No.: 302,962

[22] Filed: Jan. 30, 1989

[30] Foreign Application Priority Data

Mar. 17, 1988 [SE] Sweden ..... 8800964

[51] Int. Cl.[4] ..... D21C 9/10

[52] U.S. Cl. ..... 162/55; 162/60; 162/65

[58] Field of Search ..... 162/65, 63, 55, 60, 162/90, 25

[56] References Cited

U.S. PATENT DOCUMENTS 3,830,688 8/1974 Mannbro ..... 162/29
4,220,498 9/1980 Prough ..... 162/65 X
4,230,524 10/1980 Hasvold ..... 162/25
4,595,455 6/1986 Mannbro ..... 162/65 X

*Primary Examiner*—Peter Chin
*Assistant Examiner*—Thi Dang
*Attorney, Agent, or Firm*—Nixon & Vanderhye

[57] ABSTRACT

A method of delignification of cellulosic fiber material is described. The pulp containing said cellulosic fiber material is fed in a main line containing a main reactor in which the pulp is treated with oxygen. The pulp is screened at at lest one point in the main line, and the screen reject obtained is fed in a branch line containing at least one secondary reactor for separate treatment with oxygen. According to the invention the separate treatment with oxygen is carried out without previous refining, and the screen reject thus separately treated in said branch line is returned to the main line at a point upstream of said main reactor.

16 Claims, 1 Drawing Sheet

METHOD OF DELIGNIFICATION OF CELLULOSIC FIBER MATERIAL

FIELD AND BACKGROUND OF THE INVENTION

The present invention relates to a method of delignification of cellulosic fiber material.

U.S. Pat. No. 4,220,498 describes a method of delignification of cellulosic fiber material which is fed in a main line in order to be treated with oxygen in a main reactor. The pulp is screened at at least one point in the main line and the screen reject obtained is fed in a branch line in order to be treated separately with oxygen and then returned to the main line.

However, as a further necessary measure the screen reject is refined in order to reduce the shives content, before performing the separate oxygen treatment. Furthermore, the screen reject thus delignified must be returned to the main line at a point downstream of the main reactor, and more particularly downstream of the screening apparatus in which the screen reject was previously separated from the main line. The screen reject which is separated from the screening apparatus has a high kappa number since the bundles of fibers therein, known as shives, have not been delignified to the same extent as the other part of the pulp which is more easily accessible. Even if refining reduces the shives content, and further reducing is performed in the separate oxygen reactor, the main stream of pulp is supplied with a screen reject or shives stream which has a kappa number essentially higher than the kappa number of the main stream at the point of mixing. The pulp thus will have an undesirably high content of shives, the pulp quality will be uneven and increased quantities of chlorine are required in the bleaching department resulting in increased emission of injurious chlorine compounds. The refining required according to said patent affects the fiber length and thus also impairs the strength properties of the pulp when the shives stream rejoins the main stream. Refining also requires high amounts of energy as well as relatively expensive equipment.

SUMMARY OF THE INVENTION

The object of the present invention is to eliminate all the problems mentioned above which are associated with handling and re-introducing the screen reject from the screening stage, and thereby to achieve an improved method of delignifying cellulosic fiber material with the aid of oxygen in order to obtain a pulp which is purer in quality with respect to the shives content and more uniform in quality with respect to the degree of delignification and accompanying reduced ligning content, thereby reducing the chlorine requirement in the bleaching department which in turn results in a reduction in chlorine compounds damaging to the environment in the waste water from the beaching department. At the same time a pulp is obtained having improved strength properties and the energy requirement and equipment needed for treating the screen reject are reduced.

According to the method of the present invention it comprises the steps of feeding a pulp containing said cellulosic fiber material in a main line containing a main reactor in which the pulp is treated with oxygen, screening the pulp at at least one point in the main line and feeding the screen reject obtained in a branch line containing at least one secondary reactor for separate treatment with oxygen, wherein the improvement comprises carrying out said separate treatment with oxygen without previous refining, and returning the screen reject thus separately treated in said branch line to the main line at a point upstream of said main reactor.

Since the screen reject, delignified in the oxygen-treatment stage, is returned to the main stream at a point located upstream of the main reactor, the kappa number will not alter after mixing the screen reject into the main stream, since the two streams of material have the same or substantially the same kappa number.

The invention is particularly applicable to pulp in the medium concentration range, i.e. about 6–15%.

BRIEF DESCRIPTION OF THE DRAWINGS

The invention will be described in more detail with reference to the drawings in which.

DESCRIPTION OF ILLUSTRATED EMBODIMENT

Figure 1:
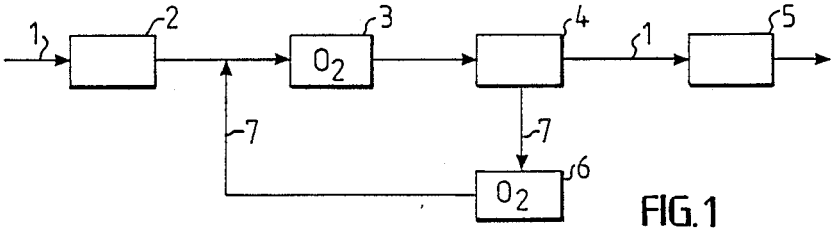
FIGS. 1 to 4 show various flow diagrams for performing the improved method.

In the flow diagram shown in FIG. 1 a main line for the main stream of pulp of cellulosic fiber material from a digester is designated 1. The main line 1 comprises a first washing apparatus 2, a main reactor 3, a screening apparatus 4 and a second washing apparatus 5. In the main reactor 3 the pulp is delignified by means of oxygen in an alkaline environment. A suitable alkali may thus be added to the pulp in the main reactor 3, in addition to oxygen. After screening and washing the pulp is subjected to further bleaching processes in a subsequent plant (not shown). At the screening stage a screen reject is obtained which is fed to a secondary reactor 6 where it is delignified by means of oxygen in an alkaline environment. In addition to the oxygen, a suitable alkali agent may thus be added to the screen reject at the secondary reactor. The secondary reactor 6 is present in a branch line 7 which according to the present invention lacks an energy consuming and bulky refiner or similar apparatus having a detrimental effect on the length of the fibers. Also according to the present invention, the branch line is connected to the main line 1 at a point located upstream of the main reactor 3 so that the delignified screen reject is mixed with the main stream and will therefore be treated with more oxygen in the main reactor 3. In this connection it is possible that some of the material previously separated as screen reject will again be separated as screen reject for repeated oxygen delignification in the secondary reactor 6 and the main reactor 3. This recirculation process is thus repeated until the material parts in question, i.e. the fiber bundles, have been reduced in size by the delignification and are allowed to accompany the main stream to subsequent bleaching processes.

Figure 2:
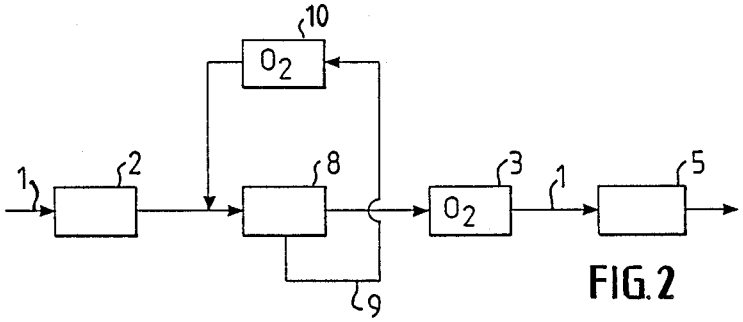

FIG. 2 shows a flow diagram according to an alternative embodiment of the invention in which, besides a main reactor 3, the main line 1 also includes a screening apparatus 8 positioned upstream of the reactor, which separates a screen reject which is passed in a branch line 9 to a secondary reactor 10 without previous treatment in a refiner in the same way as in the embodiment according to FIG. 1. The branch line 9 is connected to the main line 1 at a point located upstream of the main reactor 3 and preferably, as shown, also upstream of the screening apparatus 8, so that the delignified screen reject is mixed with the main stream and will subsequently be treated with additional oxygen in the main reactor 3. It will be understood that parts of the previously treated screen reject may be separated further by screening one or more times, until the fiber bundles have been sufficiently delignified to finally continue with the main stream and be treated for a last time in the main reactor 3, as previously described.

Figure 3:
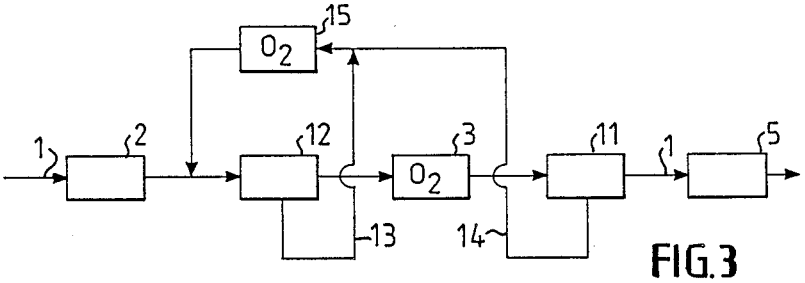

In the flow diagram, shown in FIG. 3, the main line 1 also includes, besides the main reactor 3, a screening apparatus 11 located downstream of the main reactor 3, as well as a screening apparatus 12 located upstream of the main reactor 3. The screening apparatus 12 separates a screen reject which is passed in a side line pipe 13 which joins with a side line 14 from the screening apparatus 12 so that the two screen rejects are treated in one and the same secondary reactor 15 and are thereafter supplied to the main stream upstream of the screening apparatus 12 which is arranged before the main reactor 3.

Figure 4:
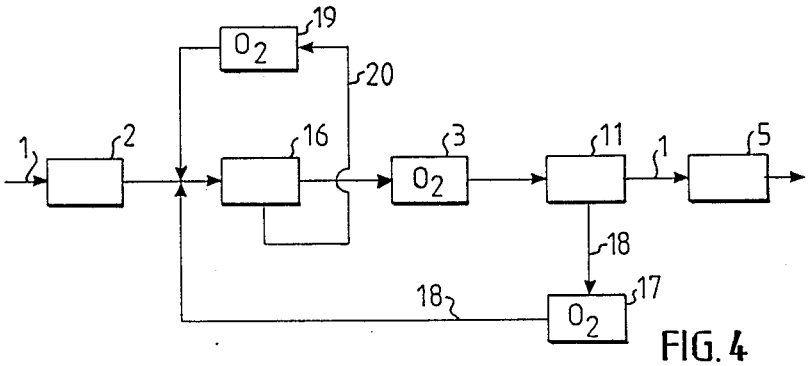

Double screening similar to that illustrated in FIG. 3 is also performed in the embodiment illustrated in FIG. 4. Besides a main reactor 3, the main line 1 also in this case includes a screening apparatus 15 located downstream of the main reactor 3, and a screening apparatus 16 located upstream of the main reactor 3. The screen reject from the screening apparatus 15 is passed to a secondary reactor 17 for oxygen delignification via a branch line 18 connected to the main line 1 at a point upstream of the screening apparatus 16, which is thus located before the main reactor 3. The screen reject from the screening apparatus 16 is passed to its own secondary reactor 19 via a branch line 20, this also being connected to the main line 1 at a point upstream of the screening apparatus.

If desired any branch line may be provided with one or more additional secondary reactors in order to increase the degree of delignification and relieve the screening apparatus since the number of times a particular bundle of fibers has to be recirculated can be correspondingly decreased.

Each separate oxygen treatment in a secondary reactor lowers the kappa number of the screen reject or shives stream. Returning the shives stream thus treated to the main stream at a point located upstream of the main reactor 3 thus ensures that the treated screen reject is subjected to yet another oxygen-delignification treatment upon passing the main reactor 3. The kappa number of the shives stream is substantially the same as that of the pulp prior to the main reactor 3, thus ensuring more uniform quality of the pulp passed to the bleaching processes after the described initial oxygen delignification process. Since according to the invention the screen reject is not refined, the fiber length, and thus the strength properties of the pulp, will be retained. The repeated oxygen delignification (at least twice) results in a reduction of the size of the fiber bundles.

That which is claimed is:

1. A method of delignifying cellulosic fiber material comprising the steps of:

(a) feeding the material in a first path in a downstream direction;

(b) effecting oxygen delignification of the material as it passes in the first path at a first position;

(c) effecting screening of the material in the first path to form accepts fraction which continues to pass in the first path, and a rejects fraction which is fed into a second path;

(d) effecting treatment of the material in the second path consisting of the step of oxygen delignification of the material in the second path; and (e) returning the treated material from the second path to the first path upstream of said first position.

2. A method as recited in claim 1 wherein step (c) is effected downstream of the first position in the first path.

3. A method as recited in claim 2 comprising the further step of also effecting screening of the material in the first path prior to the first position, to provide a rejects fraction which is fed into a third path, and effecting treatment of the material in the third path without refining the material, by effecting further delignification thereof by treatment with oxygen and returning the treated material from the third path to the first path upstream of said first position.

4. A method as recited in claim 3 wherein the rejects in both said second and third paths are returned to the first path upstream of the first screening point in the first path.

5. A method as recited in claim 3 wherein said second and third paths both lead to a common oxygen reactor, and wherein oxygen delignification in said second and third paths takes place in said oxygen reactor.

6. A method as recited in claim 3 wherein a separate oxygen reactor is provided in each of said second and third paths, distinct from each other, and wherein said oxygen delignification step in each of said second and third paths is accomplished by the oxygen reactor in each of said second and third paths.

7. A method as recited in claim 1 wherein step (c) is practiced prior to said first position in said first path.

8. A method as recited in claim 1 wherein during the entire practice of steps (a) through (e), the pulp has a consistency of between about 6–15%.

9. A method of delignifying cellulosic fiber material comprising the steps of:

(a) feeding the material in a first path in a downstream direction;

(b) effecting oxygen delignification of the material as it passes in the first path at a first position;

(c) effecting screening of the material in the first path to form accepts fraction which continues to pass in the first path, and a rejects fraction which is fed into a second path;

(d) without refining the material in the second path, effecting further delignification thereof by treatment with oxygen; and (e) returning the treated material from the second path to the first path upstream of said first position.

10. A method as recited in claim 9 wherein step (c) is effected downstream of the first position in the first path.

11. A method as recited in claim 10 comprising the further step of also effecting screening of the material in the first path prior to the first position, to provide a rejects fraction which is fed into a third path, and effecting treatment of the material in the third path without refining the material, by effecting further delignification thereof by treatment with oxygen and returning the treated material from the third path to the first path upstream of said first position.

12. A method as recited in claim 11 wherein the rejects in both said second and third paths are returned to the first path upstream of the first screening point in the first path.

13. A method as recited in claim 11 wherein said second and third paths both lead to a common oxygen reactor, and wherein oxygen delignification in said second and third paths takes place in said oxygen reactor.

14. A method as recited in claim 11 wherein a separate oxygen reactor is provided in each of said second and third paths, distinct from each other, and wherein said oxygen delignification step in each of said second and third paths is accomplished by the oxygen reactor in each of said second and third paths.

15. A method as recited in claim 9 wherein step (c) is practiced prior to said first position in said first path.

16. A method as recited in claim 9 wherein during the entire practice of steps (a) through (e), the pulp has a consistency of between about 6–15%.

* * * * *